United States Patent [19]

Heitmann et al.

[11] 4,185,644

[45] Jan. 29, 1980

[54] DISTRIBUTOR FOR CIGARETTE MAKERS OR THE LIKE

[75] Inventors: Uwe Heitmann, Schwarzenbek; Wolfgang Steiniger, Bornsen; Joachim Pfannmuller; Heinz-Christen Lorenzen, both of Hamburg; Franz-Peter Koch, Wangelau; Norbert Lange, Glinde, all of Fed. Rep. of Germany

[73] Assignee: Hauni-Werke Korber & Co. KG., Hamburg, Fed. Rep. of Germany

[21] Appl. No.: 834,782

[22] Filed: Sep. 19, 1977

[30] Foreign Application Priority Data

Sep. 24, 1976 [GB] United Kingdom ..... 39676/76

[51] Int. Cl.[2] ..... A24B 7/14

[52] U.S. Cl. ..... 131/109 R; 131/109 AB

[58] Field of Search ..... 131/84, 109 R, 109 AB, 131/108, 110; 19/97, 97.5

[56] References Cited

U.S. PATENT DOCUMENTS 3,196,880 7/1965 Pinkham ..... 131/109 R 3,276,452 10/1966 Dearsley ..... 131/109 R 3,996,944 12/1976 Hinzmann ..... 131/109 AB

*Primary Examiner*—Stephen C. Pellegrino

*Attorney, Agent, or Firm*—Peter K. Kontler

[57] ABSTRACT

A distributor for use in a cigarette maker has a relatively long and relatively narrow upright duct whose upper end receives particles of tobacco from one or more magazines by way of an endless belt. The resulting column of tobacco descends through the lower end of the duct and into the range of orbiting needles at the periphery of a horizontal drum. An oscillating barrier is interposed between the lower end of the rear wall of the duct and the path of needles close to the apex of the drum. The barrier has a profiled rib which extends into the lower end of the duct to homogenize the lower end of the descending column of tobacco as well as to promote uniform filling of gaps between the neighboring needles with particles of tobacco along the full axial length of the drum. The particles are expelled from the gaps by a picker roller and are converted into a wide carpet, thereupon into a narrow stream and finally into a rod-like filler.

10 Claims, 6 Drawing Figures

27
34
36
33

36
35
33
34

18
19
24
29
4
21
22
6A
28
23
26
31
27
III
33
32
43
37
41
39
38
42
44
46
47
50
48
49
52
64
62
61
62
58
57
63
56
59
53
51
54
V
V
F

DISTRIBUTOR FOR CIGARETTE MAKERS OR THE LIKE

CROSS-REFERENCE TO RELATED APPLICATION

The apparatus of the present invention is identical with that disclosed in our commonly owned copending application Ser. No. 835,183 filed Sept. 21, 1977 for "Distributor for use in cigarette making machines or the like", now abandoned.

BACKGROUND OF THE INVENTION

The present invention relates to improvements in machines for the production of rod-shaped smokers' products of the type wherein a rod-like filler consisting of natural, reconstituted and/or substitute tobacco is draped into a web of cigarette paper, imitation cork or other suitable wrapping material. More particularly, the invention relates to improvements in distributors for use in cigarette makers or the like. The distributor constitutes that part of the maker wherein tobacco and/or other fibrous material is withdrawn from one or more magazines and is classified and/or otherwise processed on its way to the stream- amd rod-forming stations.

The operation of the distributor greatly influences the quality of rod-shaped smokers' products. For example, reliable segregation of all large ribs, particles of metal and other constituents which are likely to affect the appearance, taste and/or density of the filler is an important factor which must be considered in designing a distributor. Other factors include adequate homogenization, reduction of the percentage of short tobacco and tobacco dust, and prevention of localized accumulations of short tobacco in the filler.

It is already known to improve the homogenizing action of the distributor in a cigarette making or analogous machine by equipping the distributor with a device which accumulates a relatively small intermediate supply of tobacco particles between the magazine and the rod-forming station. It is also known to construct the tobacco accumulating device in the form of a duct whose discharge end is adjacent to a rotary conveyor having pins or like protuberances for removal and further transport of particles from the leader of the intermediate supply. However, the presently known distributors cannot insure reliable (i.e., accurately predictable) rate of tobacco withdrawal from the intermediate supply. Such predictable rate of withdrawal is a prerequisite for satisfactory homogenization of tobacco prior to conversion into a rod-like filler.

East German Pat. No. 2854 published Jan. 21, 1953 discloses a distributor wherein a needle wheel withdraws tobacco from a downwardly sloping duct and a picker roller propels tobacco from the periphery of the wheel directly into a tobacco stream forming channel.

German Offenlegungsschrift No. 2,357,132 discloses a distributor wherein a tall and relatively narrow downwardly sloping duct receives tobacco from a first picker roller and from which tobacco is removed by a needle wheel. One side wall of the duct is reciprocated to promote the downward movement of tobacco in the duct.

OBJECTS AND SUMMARY OF THE INVENTION

An object of the invention is to provide a distributor for use in cigarette, cigar or cigarillo makers wherein the particles of fibrous material (such particles may include natural tobacco, reconstituted tobacco and/or tobacco substitutes) are homogenized at least once during transport from one or more magazines toward the locus where the particles are caused to form a continuous rod-like filler.

Another object of the invention is to provide the distributor with novel and improved means for homogenizing successive increments of a relatively small intermediate supply of fibrous particles intermediate the magazine or magazines and the rod forming station.

A further object of the invention is to provide the distributor with novel and improved means for promoting the filling and for insuring uniform or nearly uniform filling of gaps between neighboring needles or analogous tobacco-removing protuberances on a conveyor which serves to evacuate fibrous material from the enclosure (e.g., a duct) for the intermediate supply.

An additional object of the invention is to provide predictable evacuation of fibrous material from the enclosure.

The invention is embodied in a distributor for use in cigarette makers or analogous machine wherein particles of tobacco and/or other fibrous material are converted into a continuous rod-like filler ready to be draped into cigarette paper or other suitable wrapping material. The distributor comprises a duct having a first (preferably the upper) and a second open end and a wall which extends between the first and second ends (the wall is or may be an upright wall whose lower end is adjacent to the second end), an endless belt or other suitable means for admitting fibrous particles into the duct by way of the first end so that the admitted particles form an intermediate supply (preferably a flat slab-like upright column) whose leader advances toward, into and beyond the second end, a preferably horizontal and preferably rotary conveyor having a plurality of protuberances (e.g., needles or pins extending radially beyond the body of the conveyor and defining a plurality of particle-receiving clearances or gaps) which constitute article-removing elements and travel along a predetermined path a portion of which is adjacent to the second end of the duct and is spaced apart from the lower end of the wall, a homogenizing device disposed between the lower end of the wall and the first portion of the path, and an eccentric or analogous means for oscillating the homogenizing device substantially transversely of the conveyor (i.e., substantially at right angles to the axis of a rotary conveyor) to thereby homogenize the leader of the column and to cause the particles of the homogenized leader to enter and substantially uniformly fill the gaps between the removing elements.

The length of the duct preferably equals the axial length of the conveyor, the height of the duct is preferably a relatively small first fraction, and the width of the duct is preferably a smaller second fraction of the length. The wall is preferably located downstream of the second end of the duct, as considered in the direction of rotation of the conveyor, most preferably downstream of the apex of the conveyor.

The homogenizing device preferably comprises an elongated profiled portion (e.g., a rib extending in parallelism with the axis of the conveyor) which extends into or close to the second end of the duct. Such profiled portion is preferably closely adjacent to the first portion of the path and may be provided with a row of alternating hills and valleys bounded by a particle-contacting surface having arcuate portions which gradually merge into each other. The hills promote the passage of particles first between the valleys and thereupon into the clearances or gaps between the neighboring removing elements in the first portion of the path.

The improved distributor insures that the particles which are removed by the conveyor can be converted into a highly homogenous layer or stream prior to conversion of the latter into a rod-like filler.

The novel features which are considered as characteristic of the invention are set forth in particular in the appended claims. The improved distributor itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
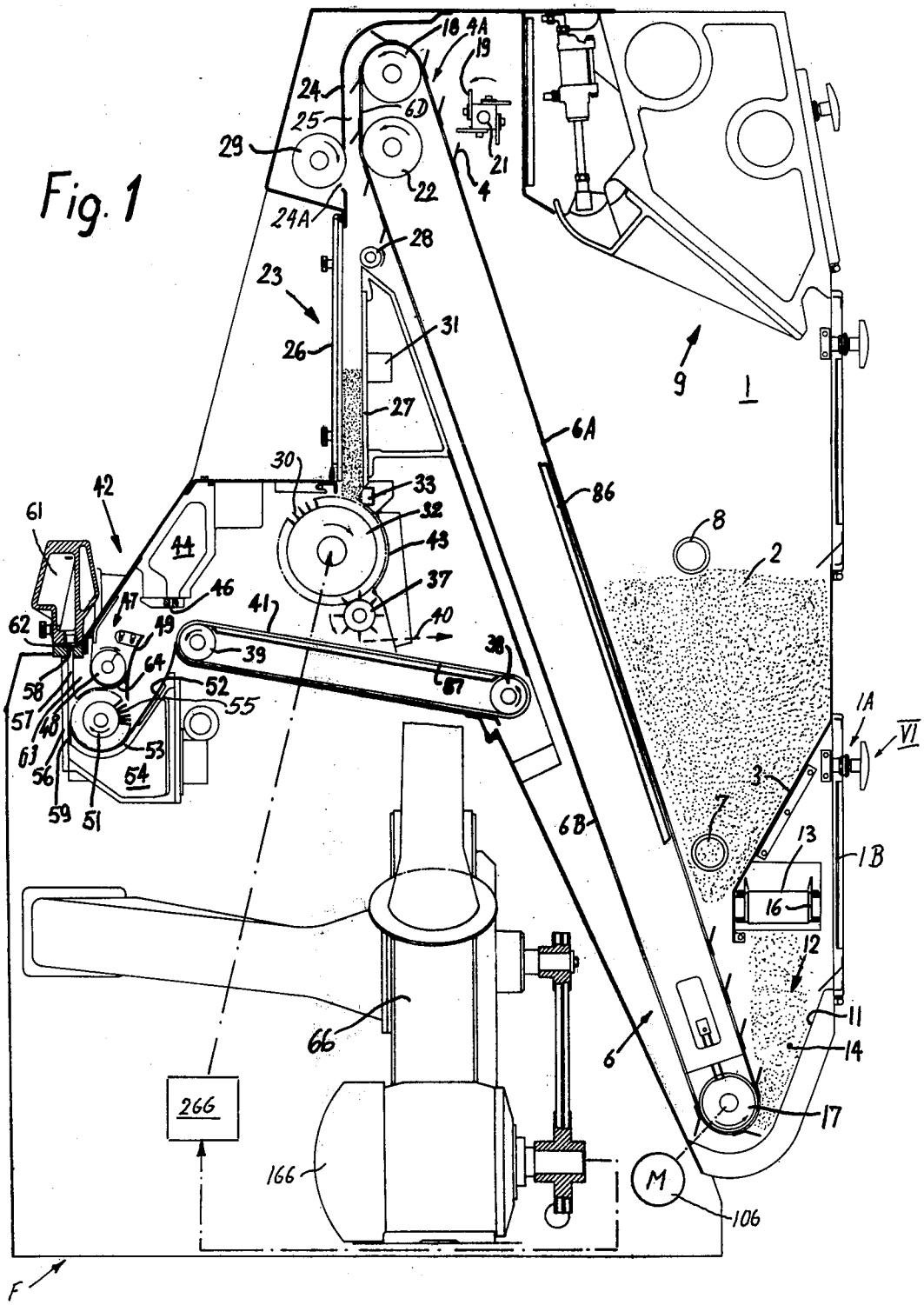
FIG. 1 is a schematic vertical sectional view of a distributor which embodies the invention and is designed for use in a cigarette maker.

The distributor of FIG. 1 comprises a main or first magazine 1 for a supply 2 of comminuted tobacco particles. The lower portion of the magazine 1 is formed in part by an inclined wall 3 and in part by the upwardly moving elongated reach 6A of a steep endless tobacco withdrawing belt conveyor 6 having equally spaced entraining elements 4 defining with the endless belt 6B of the conveyor 6 a series of pockets 4A for transport of tobacco particles toward and around a guide roller 18 at the upper end of the withdrawing conveyor 6. The inclination of the wall 3 is preferably adjustable, and this wall is located behind a door 1A having an observation window 1B. The slope of the left-hand side of the wall 3 (as viewed in FIG. 1) is selected in such a way that the particles of the supply 2 can readily slide into the bottom zone of the main magazine 1 but that such sliding movement is not accompanied by pronounced mixing or rolling of descending particulate material.

The means for monitoring the level of the supply 2 of tobacco particles in the main magazine 1 comprises an upper level detector 8 and a lower level detector 7. Each of these level detectors is preferably a photocell. The arrangement is such that, when the upper level of the supply 2 descends below the detector 8, the latter furnishes a signal which causes a gate 9 at the upper end of the main magazine 1 to open and to admit a batch of tobacco particles from a main source of supply, not shown. The means for transporting tobacco from the main source into the magazine 1 in response to opening of the gate 9 preferably comprises a pneumatic conveyor tube of the type customarily employed in cigarette makers. When the upper level of the supply of tobacco particles descends below the detector 7, the latter transmits a signal which arrests the main prime mover of the cigarette maker.

The main magazine 1 is mounted in the frame F of the cigarette maker, and this frame further supports an arcuate wall 11 which cooperates with the lower portion of the upwardly moving reach 6A of the withdrawing conveyor 6 to define a second or auxiliary magazine 12 for the storage of tobacco particles 14; such particles constitute the excess or surplus which is removed from the fully grown tobacco stream 71 (see FIG. 5) in order to convert the stream into a continuous rod-like filler 71A. The means for conveying the removed surplus into the auxiliary magazine 12 comprises an endless belt conveyor 13 whose discharge end is trained over a guide roller 16. The admission of trimmed-off surplus tobacco 14 into the auxiliary magazine 12 can be observed through the window 1B. The discharge end of the surplus supplying conveyor 13 is preferably located midway between the two marginal portions 6*a*, 6*b* (see FIG. 6) of the withdrawing conveyor 6. FIG. 6 further shows that the outlet 112 of the relatively narrow auxiliary magazine 12 is located substantially midway between the marginal portions 6*a*, 6*b* of the upwardly moving reach 6A of the withdrawing conveyor 6. The outlet 101 of the main magazine 1 is wider than and extends laterally beyond both sides of the outlet 112. This insures that the particles of supply 2 which are withdrawn from the magazine 1 cover or overlap and extend laterally beyond the particles 14 which are withdrawn from the auxiliary magazine 12. The particles 14 travel substantially centrally of the distributor during movement from the magazine 12 and all the way to the stream building or growing zone A (FIG. 5) of the cigarette maker. During travel with the entraining elements 4, the particles 14 fill or partially fill the central portions and the particles of the supply 2 fill or nearly fill the remaining (major) portions of the respective pockets 4*a*.

The lower guide roller 17 of the withdrawing conveyor 6 is driven by a separate prime mover 106, preferably at a variable speed. Each entraining element 4 which travels around the lower guide roller 17 and thereupon toward the upper guide roller 18 removes tobacco particles 14 from the auxiliary magazine 12 and thereupon a certain amount of tobacco from the supply 2 in the main magazine 1. Successive filled pockets 4*a* thereupon advance past a rotary refuser 21 here shown as a paddle wheel having blades or paddles 19 consisting of leather strips. The shaft of the refuser 21 is driven by the upper guide roller 18 through the medium of an endless belt or chain (not shown), and the refuser 21 rotates anticlockwise, as viewed in FIG. 1, so that it removes the surplus from successive pockets 4*a* and causes the removed particles to descend into the main magazine 1.

The endless flexible belt 6B of the withdrawing conveyor 6 is further trained over an additional roller 22 which is disposed at a level below the guide roller 18 and causes the belt 6B to define a relatively short vertical stretch 6D which is tangential to the rollers 18 and 22. This insures that the contents of successive pockets 4*a* are reliably evacuated immediately or shortly after such pockets complete their travel around the roller 18. The stretch 6D cooperates with the lower portion of a stationary side wall 24 to define therewith a vertical passage 25 wherein the contents of successive pockets 4a descend toward and into the upper end of a narrow upright duct 23. The upper portion of the side wall 24 is curved so that its spacedly surrounds the roller 18 and insures that the contents of successive pockets 4a enter the upper end of the passage 25. The passage 25 begins at the twelve o'clock position of the roller 18 and its width is preferably constant all the way to the nine o'clock position of the roller 22. The lower portion of the side wall 24 constitutes an upward extension of front side wall 26 of the duct 23 and is formed with an opening 24A adjacent to a portion of a rotary magnet 29 serving to attract metallic particles which might be present in the channel 25. A driven roll 28 is mounted at the upper end of the duct 23 adjacent to the path of entraining elements 4 to prevent particles of tobacco (especially relatively long shreds of tobacco leaf laminae) from adhering to or piling up at the upper end of the rear wall 27 of the duct 23.

The means for regulating the speed of the prime mover 106 for the lower guide roller 17 comprises a composite monitoring device 31 which is mounted on the rear wall 27 and serves to transmit signals denoting the height of the relatively small intermediate supply (here shown as a column or pile) of tobacco particles in the duct 23. This is tantamount to monitoring of the quantity of tobacco particles in the duct 23. The monitoring device 31 preferably comprises a battery of photoelectric cells whose light sources and transducers are mounted in such a way that the light beam issuing from the source reaches the transducer of the respective cell if it is reflected by tobacco particles in the adjacent portion of the duct 23. The cells of the monitoring device 31 are mounted at different levels and at different distances from the observer of FIG. 1, and each thereof transmits a signal when its light source is buried in the tobacco pile for a certain interval of time (i.e., the transducers of such cells transmit signals with a certain delay). The signal from the uppermost cell which is buried in the pile of tobacco determines the speed of the prime mover 106. The monitoring device 31 insures that the height of the pile (and hence the quantity) of tobacco particles in the duct 23 is constant or fluctuates for relatively short intervals of time. The connections between the transducers of the cells in the monitoring device 31 and the prime mover 106 preferably contain relays which determine the aforementioned delays of signal transmission for changing the speed of the conveyor 6.

The duct 23 feeds the leader or lower end portion of the column or pile of tobacco particles therein into the range of needles, pins or analogous particle-removing protuberances 30 at the periphery of a rotary drum-shaped removing conveyor 32. The outlet of the duct 23 is preferably located at the one o'clock position of the removing conveyor 32, as viewed in FIG. 1, i.e., the lower end of the wall 27 is not in register with the apex of the conveyor 32. The latter receives torque from the main prime mover 166 of the cigarette maker by way of an infinitely variable speed transmission 266. The arrow shows that the conveyor 32 is driven in a clockwise direction, as viewed in FIG. 1.

Figures 2, 3, 4:
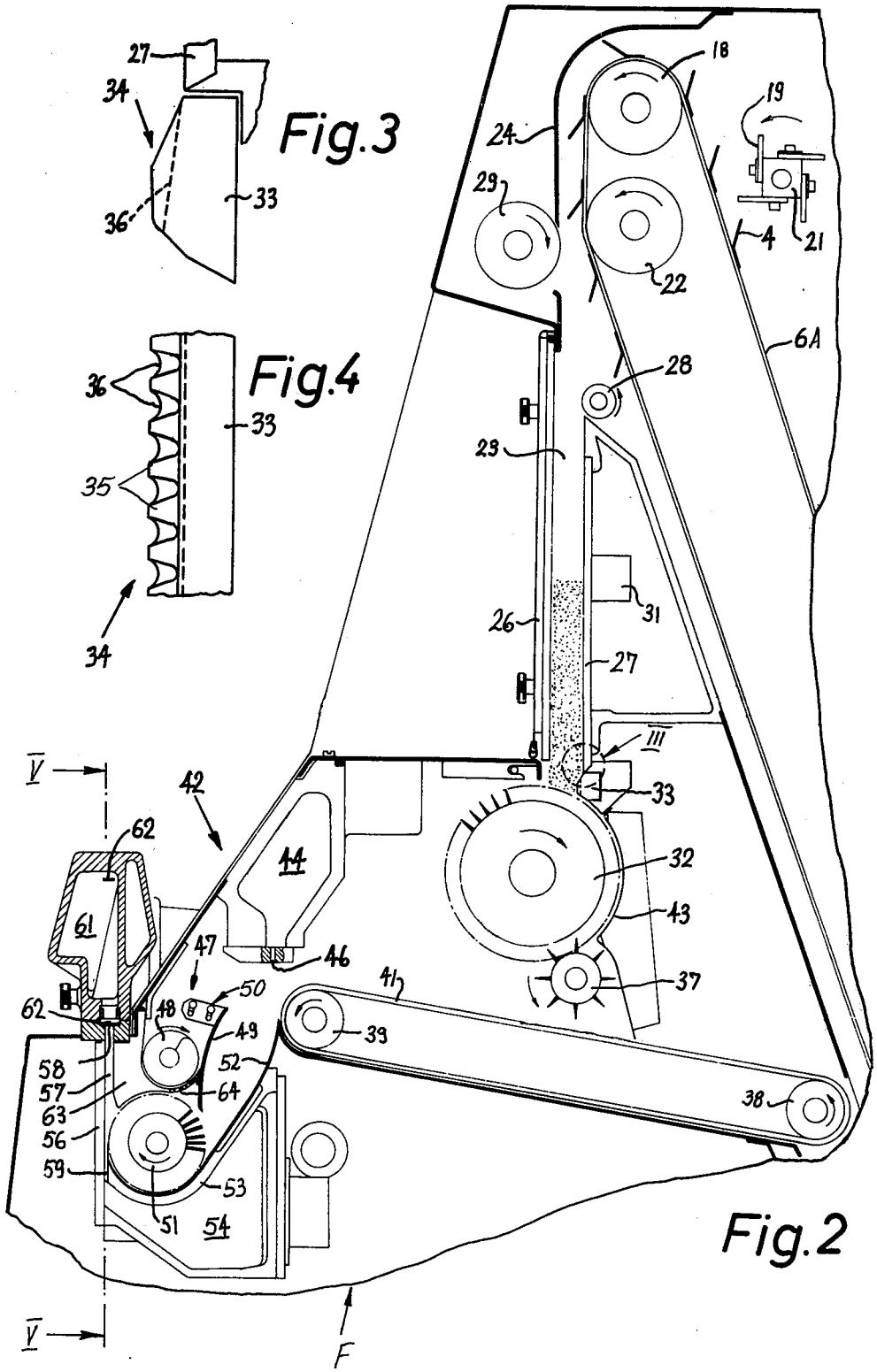
FIG. 2 is an enlarged view of a detail in the distributor of FIG. 1.
FIG. 3 an enlarged view of a detail within the broken-line circle III of FIG. 2.
FIG. 4 is a plan view of a reciprocable homogenizing device which is shown in FIG. 3.

The removing conveyor 32 cooperates with a reciprocating homogenizing device or barrier 33 (see also FIGS. 3 and 4) which is adjacent to the right-hand side of the outlet of the duct 23 and serves to insure that the gaps between the needles 30 of the conveyor 32 are filled with tobacco particles. The barrier 33 is oscillatable at right angles to and/or in the plane of FIG. 1, for example, in a manner as disclosed in commonly owned U.S. Pat. No. 3,996,944 granted Dec. 14, 1976 to Alfred Hinzmann. The disclosure of Hinzmann is incorporated herein by reference. The frequency of reciprocatory movement of the barrier 33 is synchronized with the RPM of the conveyor 32. The barrier 33 fills the space between the lower end of the rear wall 27 of the duct 23 and the tips of the adjacent needles 30. As shown in FIGS. 2, 3 and 4, the barrier 33 has an elongated projection or rib 34 which is parallel to the axis of the removing conveyor 32 and extends into the lowermost part of the duct 23. The ridge of the rib 34 is formed with alternating hills 35 and valleys 36 which are bounded by a surface having rounded or arcuate portions of such configuration that the rib 34 cannot intercept the descending tobacco particles but merely steers the descending particles into the clearances or gaps between the neighboring needles 30. In other words, the particles of tobacco cannot accumulate in the valleys 36 but are compelled to advance beyond the barrier 33 and to move into the range of needles 30 on the rotating withdrawing conveyor 32. The aforementioned portions of the surface bounding the hills 35 and valleys 36 of the rib 34 merge gradually into each other.

The barrier 33 can be oscillated by an eccentric which receives motion from the main prime mover 166.

A picker roller 37 which is mounted in the frame F at the five o'clock position of the removing conveyor 32 is driven at a relatively high constant speed to expel the particles of tobacco from the gaps between the needles 30 and to propel the particles onto the upper reach of an endless conveyor band 41 which is trained over pulleys 38 and 39. One of the pulleys 38, 39 is driven at a constant speed so that the carpet of tobacco particles which accumulate on the upper reach of the band 41 is advanced in a direction to the left, as viewed in FIG. 1, and its leader is caused to enter a primary classifying unit 42. The right-hand portions of the removing conveyor 32 and picker roller 37 are adjacent to a suitably configurated shroud 43 which is mounted in the frame F. The shroud 43 prevents the particles of tobacco from leaving the periphery of the conveyor 32 upstream of the picker roller 37; furthermore, the shroud 43 extends all the way to the upper reach of the band 41 to insure that the pins of the picker roller 37 (which is driven in a counterclockwise direction, as viewed in FIG. 1) cannot propel tobacco particles rearwardly, i.e., to the right and above the upper reach of the band 41 (as indicated by the broken-line arrow 40). The band 41 preferably consists of or has an outer layer made of rubber or other suitable elastomeric material, and the outer side of such layer is suitably profiled to insure that the particles of tobacco which are propelled by the picker roller 37 advance toward and beyond the pulley 39 without any or with minimal slippage.

The primary classifying unit 42 comprises a plenum chamber 44 the bottom wall of which has a row of square openings or orifices 46 for streamlets of compressed air. Such streamlets together form a gaseous curtain which intercepts the lighter tobacco particles but permits the passage of heavier particles. The orifices 46 are closely adjacent to each other so that the streamlets form a practically uninterrupted curtain which is located in a plane extending transversely of the flight spans of particles advancing beyond the discharge end of the band 41. The heavier particles traverse the gaseous curtain and are collected in an intercepting receptacle 47 containing in its bottom zone a feed screw 48 which is rotated to evacuate the accumulated heavier particles from the container 47. The heavier particles which enter the container 47 are mainly ribs whose kinetic energy is sufficiently high to insure that such particles are not appreciably affected by the braking action of the gaseous curtain.

An arcuate baffle 49 behind the curtain of compressed air issuing from the orifices 46 is adjustably mounted in the frame F between the receptacle 47 and pulley 39 and serves to intercept the lighter particles which are deflected by the streamlets of air, i.e., whose flight spans are radically altered by the streamlets. The arrangement is preferably such that the baffle 49 is adjustable up and down (see the pin-and-slot connection 50 between the upper part of the baffle and the frame F in FIG. 2) so that it can intercept a larger or smaller percentage of particles which are propelled beyond the discharge end of the band 41. The right-hand side of the baffle 49 (as viewed in FIG. 1 or 2) is concave so that the baffle causes the intercepted lighter particles to slide downwardly along such concave side and to advance into the range of a rotary drum-shaped transfer conveyor 51 having radially extending pins or needles 55. The conveyor 51 is driven to rotate at a constant speed in a clockwise direction, as viewed in FIG. 1. The baffle 49 is located opposite a suitably curved wall member 52 which defines therewith a funnel the open lower end of which is adjacent to the path of needles 55 at the periphery of the transfer conveyor 51.

The lower portion of the transfer conveyor 51 is surrounded by a second plenum chamber 54 having a top wall 53 whose curvature is similar to that of the periphery of the conveyor 51.

The outlet of the plenum chamber 54 blows compressed air into the lower part of an upwardly extending tobacco channel 57 having a side wall 56 which is substantially tangential to the conveyor 51. The curvature of the top wall 53 is such that this wall merges gradually into the side wall 56. The upper end of the channel 57 is located at the underside of the lower reach of a narrow endless foraminous tobacco stream forming belt conveyor 58 which travels at right angles to the plane of FIG. 1 or 2. The side wall 56 is formed with grooves 59 which are inclined upwardly and forwardly, as considered in the direction of movement of the lower reach of the conveyor 58. Reference may be had to the commonly owned copending application Ser. No. 795,560 of Uwe Heitmann, filed May 10, 1977 for "Apparatus for building a continuous tobacco stream" wherein the grooves in the side wall of the tobacco channel are described, shown and claimed in considerable detail. The lower reach of the conveyor 58 travels below the perforated bottom wall of a suction chamber 61 which contains metallic or ceramic pins or studs 62 defining the endless path for the conveyor 58.

The other side wall 63 of the tobacco channel 57 (this wall is located opposite the side wall 56) overlies the upper part of the transfer conveyor 51. If desired, the side wall 63 can be provided with suction ports whose inlets are adjacent to the path of needles 55 on the conveyor 51. The side wall 63 further constitutes a trough for the feed screw 48 in the intercepting receptacle 47 and has suction ports (not shown) in the region adjacent to the baffle 49 so that the corresponding portion 64 of the wall 63 constitutes a sieve.

The means for admitting compressed air into the plenum chambers 44, 54 and for drawing air from the suction chamber 61 comprises a blower 66 which is mounted in the frame F below the band 41. It is clear, however, that the apparatus can be equipped with a discrete source of compressed air from each plenum chamber (or with a common source of compressed air for both plenum chambers) and with a discrete suction generating device for the chamber 61. The blower 66 is driven by the main prime mover 166.

Figure 5:
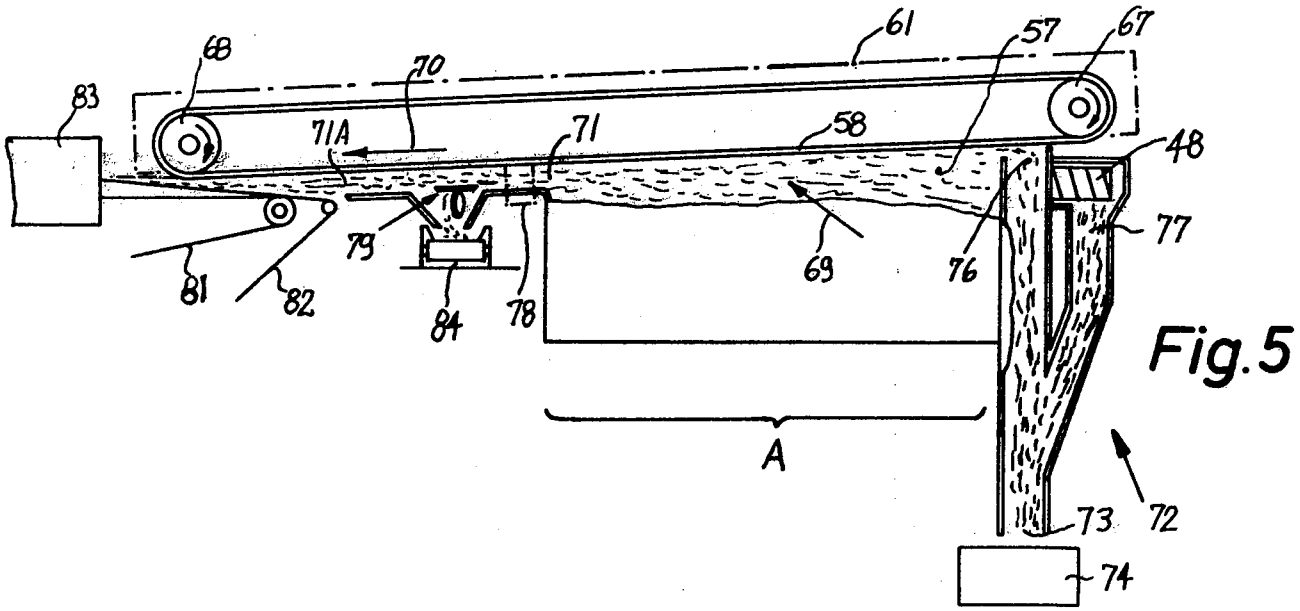
FIG. 5 is an enlarged sectional view substantially as seen in the direction of arrows from the line V—V of FIG. 2.
Figure 6:
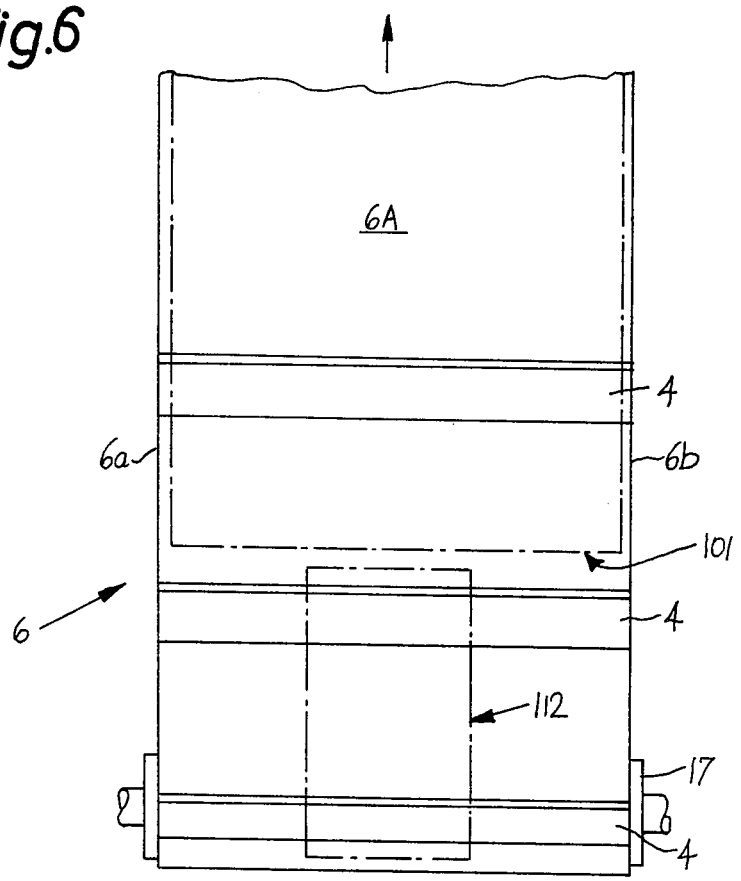
FIG. 6 is a schematic view of a detail as seen in the direction of arrow VI in FIG. 1.

FIG. 5 shows that the stream forming belt conveyor 58 is trained over pulleys or guide rollers 67, 68 which are mounted in the suction chamber 61 (indicated schematically by phantom lines). The tobacco stream building or growing zone A receives particles of tobacco from the channel 57 and the particles are caused to travel in the direction indicated by arrow 69, i.e., in the general direction of the streams of compressed air which issue from the plenum chamber 54 and are caused to flow in the aforementioned upwardly and forwardly inclined grooves 59 of the side wall 56. Reference may be had again to the aforementioned commonly owned copending application Ser. No. 795,560 of Heitmann.

The stream building zone A is preceded by a secondary or auxiliary classifying unit 72 which comprises a first outlet 73 disposed above a container 74 for collection of heavier particles, a second outlet 76 at the upstream end of the stream building zone A (i.e., at the right-hand end of the lower reach of the conveyor 58, as viewed in FIG. 5), and an inlet 77 which receives tobacco particles from the receptacle 47. The suction chamber 61 draws lighter tobacco particles against the underside of the lower reach of the foraminous conveyor 58 via outlet 76 of the secondary classifying unit 72.

A device 78 which monitors the height of the fully grown tobacco stream 71 at the underside of the conveyor 58 is mounted downstream of the stream building zone A. The monitoring device 78 is located immediately upstream of a trimming or equalizing device 79 which removes the excess or surplus of tobacco particles from the stream 71 so that the latter is converted into a continuous filler 71A of constant height. The equalizing device 79 is adjustable in directions toward and away from the undulate underside of the fully grown stream 71 in response to signals furnished by a density measuring device which is adjacent to the path of the filler or to the path of the continuous cigarette rod. The position of the equalizing device 79 with respect to the underside of the lower reach of the conveyor 58 is indicative of the height of the trimmed stream (filler 71A) of tobacco particles. The position of the equalizing device 79 is monitored by a signal generating device (not shown) and the signals from the signal generating device are compared with or otherwise related to signals furnished by the monitoring device 78. The resulting signals are used to regulate the aforementioned infinitely variable speed transmission 266 for the removing conveyor 32 in such a way that the surplus of tobacco particles in the fully grown stream 71 is constant or nearly constant. Reference may be had to the commonly owned copending application Ser. No. 821,179 of Uwe Heitmann et al., filed Aug. 2, 1977 for "Method and apparatus for producing a rod-like tobacco filler" wherein the construction and operation of the monitoring device 78, adjustments of the equalizing device 79 in response to signals from a density measuring device, and the manner in which the transmission 266 for the removing conveyor 32 is regulated are described and shown in full detail.

The downstream end of the conveyor 58 (including the pulley 68) overlies a garniture 81 which forms part of a wrapping mechanism 83 and serves to transport a continuous web 82 of cigarette paper or other suitable wrapping material. The web 82 is draped around the filler 71A to form therewith a continuous cigarette rod which is thereupon severed at regular intervals by a conventional cutoff (not shown) to yield a file of discrete plain cigarettes of unit length or multiple unit length.

The surplus or excess which is removed by the equalizing device 79 descends onto the upper reach of a conveyor 84 (e.g., an endless belt) which is adjacent to the distributor and whose discharge end delivers the removed surplus onto the upper reach of the conveyor 13 shown in FIG. 1 so that the latter can admit the surplus into the auxiliary magazine 12. The conveyors 13 and 84 are preferably operable independently of each other; however, each of these conveyors preferably receives motion from the main prime mover 166 of the cigarette maker.

The right-hand reach 6A of the withdrawing conveyor 6 (as viewed in FIG. 1 or 2) is adjacent to a back support 86 which may constitute a rail fixedly but preferably adjustably mounted in the frame F. A similar back support or rail 87 is provided below the upper reach of the band 41. The rails 86 and 87 are preferably provided with grooves or recesses which are adjacent to the marginal portions of the respective conveyors 6 and 41 and serve to prevent or reduce the likelihood of accumulation of tobacco dust. To this end, the grooves are inclined in the direction of forward movement of the respective conveyors.

The operation:

The main magazine 1 receives batches of tobacco particles on opening of the gate 9 in response to signals from the upper level detector 8. As mentioned above, the lower level detector 7 automatically arrests the main prime mover 166 of the cigarette maker when the level of the upper surface of the supply 2 in the main magazine 1 descends below the light beam issuing from the light source of 7 so that the light beam is free to impinge upon the associated transducer.

The prime mover 106 for the withdrawing conveyor 6 is on so that the entraining elements 4 remove particles from the supply 2 while travelling from the guide roller 17 toward the guide roller 18. The pockets **4*a* which are defined by the entraining elements 4 and the reach 6A of the withdrawing conveyor 6 are relatively small so that each such pocket accommodates and advances a relatively small amount of tobacco particles. The amounts are equalized by the paddles 19 of the refuser 21. The equalized amounts of tobacco particles leave the respective pockets 4*a* during travel of corresponding entraining elements 4 along the curved upper portion of the stationary side wall 24 and descend in the passage 25 toward and into the upper end of the duct 23. The evacuation of such amounts from the respective pockets 4*a* is terminated not later than when the corresponding entraining elements 4 reach the roller 22. The fact that the passage 25 is vertical or nearly vertical contributes to reliable evacuation of the contents of successive pockets 4*a*. The lower portion of the side wall 24 directs the descending tobacco into the central zone of the upper end of the duct 23. Particles of iron or other magnetizable material are attracted to the periphery of the continuously rotating magnet 29 so that they cannot enter the duct 23. The periphery of the magnet 29** travels along a suitable scraper (not shown) which separates the accumulated metallic particles and causes them to descend into a collecting bin, not shown.

The device 31 monitors the level of tobacco pile in the duct 23 and regulates the speed of the prime mover 106 in the aforedescribed manner, i.e., so that the upper level of the intermediate supply of tobacco particles in the duct 23 is constant or fluctuates very little above or below a desirable optimum level. The speed of the prime mover 106 is preferably adjustable in stepwise fashion, and the momentary speed is determined by the number of transducers, forming part of the device 31, which receive reflected light from the associated light sources.

The gaps between the needles 30 of the removing conveyor 32 are filled with tobacco, partly as a result of gravitational descent of the column of particles in the duct 23 and partly under the action of the oscillating barrier 33. The rib 34 of the barrier 33 insures that each gap is completely filled with particles or that the filling of all gaps advancing below the outlet of the duct 23 is at least substantially uniform. The just mentioned desirable filling action of the barrier 33 is attributable to the fact that the hills and valleys 35, 36 promote the entry of tobacco particles between the needles 30 and also to the fact that the rib 34 agitates the lower end of the column of tobacco particles in the duct 23 so that the particles are unlikely to form bridges which would prevent predictable descent of the column into the range of the needles 30. The shroud 43 insures that the particles which are entrained by the needles 30 continue to travel with the removing conveyor 32 all the way into the range of the picker roller 37 which propels the particles onto the upper reach of the band 41. If desired, the lower portion of the shroud 43, immediately upstream of the picker roller 37, may resemble or constitute a comb, i.e., it can be formed with prongs or tongues alternating with slots. The teeth or pins of the roller 37 then extend into such slots.

As a rule, the relatively long particles of tobacco (particularly longer shreds of tobacco leaf laminae) normally remain in engagement with the pins of the roller 37 for a longer interval of time so that they leave the picker roller at a locus which is close to the upper reach of the band 41. On the other hand, the smaller particles leave the picker roller 37 practically immediately and therefore take a longer interval of time to advance onto the upper reach of the band 41. This is of advantage for the classifying action of the unit 42. The lower portion of the shroud 43 insures that the particles which are propelled by the pins of the roller 37 cannot travel in the direction indicated by arrow 40 and thus cannot bypass the upper reach of the band 41.

The band 41 is driven at a constant speed and advances the carpet or layer thereon in a direction toward and beyond the guide roller 39, i.e., into the primary classifying unit 42. The thus propelled particles are influenced by the curtain of compressed air which is formed by streamlets issuing from the openings or orifices 46 of the plenum chamber 44. The lighter particles are deflected into the funnel which is defined by the baffle 49 and wall member 52, and the heavier particles traverse the curtain and enter the collecting receptacle 47. The heavier particles include fragments of ribs. An advantage of the aforementioned preliminary classification of particles on the band 41 (the separation of longer shreds from the roller 37 takes place upstream of the locus where the lightest and heavier particles reach the band 41) is of advantage because the heavier particles lie on top of lightest particles and shreds so that the shreds cannot interfere with advancement of heavier particles across the curtain of streamlets of compressed air and into the receptacle 47. The deflecting action of streamlets of air issuing from the orifices 46 and acting upon the lighter particles may but need not be very pronounced; however, it must suffice to insure that all lighter particles (or the majority of lighter particles) are caused to descend into the space between the baffle 49 and wall member 52 on their way into the range of orbiting needles 55 at the periphery of the transfer conveyor 51. The needles 55 propel the particles into the channel 57. The configuration and inclination of the wall member 52 are such that the streamlets of air issuing from the orifices 46 and impinging upon the wall member 52 make a relatively small acute angle with the left-hand side of this wall member (as viewed in FIG. 1 or 2) so that the streamlets flow downwardly along the left-hand side of the wall member 52 and promote the travel of particles toward the periphery of the transfer conveyor 51. Moreover, such configuration and inclination of the wall member 52 insure that the particles which descend in the funnel between 49 and 52 are subjected to negligible agitating action.

The heavier particles which enter the receptacle 47 are transported by the feed screw 48 toward the inlet 77 of the secondary classifying unit 72 (see FIG. 5). The useful constituents of the material which enters into and is advanced along the bottom wall of the receptacle 47 can pass through the interstices of the sieve 64 and enter the funnel between the baffle 49 and wall member 52 to be introduced into the channel 57. Such useful constituents of particles which have traversed the curtain and have entered the receptacle 47 include the so-called birds' eyes., i.e., relatively short fragments of ribs which are not likely to puncture the cigarette paper web 82.

The particles which enter the channel 57 are entrained by the air streams issuing from the plenum chamber 54 and flowing in part in the grooves 59 of the side wall 56 so that the particles advance toward the underside of the lower reach of the foraminous conveyor 58 in the direction indicated by arrow 69 shown in FIG. 5. Thus, the particles of tobacco have a vertical component of movement (toward the underside of the suction chamber 61) and a substantially horizontal component of movement in the direction in which the conveyor 58 transports the wedge-like stream which grows in the stream building zone A. Such orientation of tobacco particles which travel toward and into the zone A is desirable because each particle which impinges upon the underside of the conveyor 58 or upon the underside of the growing stream need not undergo pronounced acceleration in the direction indicated by arrow 70; in fact, the acceleration of particles in such direction is extremely small.

The streamlets of air which issue from the orifices 46 of the plenum chamber 44 and the stream or streams of air which issue from the outlet of the plenum chamber 54 are drawn into the suction chamber 61 which insures that the growing tobacco stream (and thereupon the fully grown stream 71) adheres to the underside of the lower reach of the conveyor 58. As mentioned above, air issuing from the orifices 46 assists the movement of tobcco particles into the range of needles 50 on the transfer conveyor 51 and such air thereupon flows around the lower part of the conveyor 51 to enter the channel 57.

The heavier tobacco particles which traverse the curtain of compressed air formed by streamlets issuing from the orifices 46 enter the receptacle 47 and are advanced by the feed screw 48 toward and into the inlet 77 of the secondary classifying unit 72. The pressure at the inlet 77 is below atmospheric pressure because this inlet communicates with the suction chamber 61 through the foraminous conveyor 58 whereby the air stream flowing from the inlet 77 toward the outlet 76 segregates the remaining lighter particles from the material which is admitted by the feed screw 48 to thus complete the segregation of all useful material from the heavier particles. The heavier particles descend in the secondary classifying unit 72 to pass through the outlet 73 and to fall into the container 74.

The particles which are segregated by the secondary classifying unit 72 and advance toward and beyond the outlet 76 constitute or include a relatively high percentage of so-called short tobacco. Such short tobacco forms the innermost (uppermost) stratum of the growing tobacco stream, i.e., that stratum which is nearest to the underside of the lower reach of the conveyor 58 and is remotest from the rotary knife or knives of the equalizing device 79. This insures that short tobacco is not comminuted by the device 79 but forms part of the equalized stream or filler 71A.

The equalizing device 79 removes the surplus from the fully grown stream 71, and the removed surplus descends onto the conveyor 84 which transports such material onto the conveyor 13 for delivery into the auxiliary magazine 12.

The auxiliary magazine 12 cannot be overfilled with tobacco particles because the conveyors 84 and 13 are driven only when the main prime mover 166 of the cigarette maker is on. Furthermore, the entraining elements 4 of the withdrawing conveyor 6 invariably remove batches of tobacco from the supply 14 whenever the prime mover 106 for the conveyor 6 is on so that the conveyor 6, too, reduces the likelihood of overfilling of the auxiliary magazine 12. The material which is entrained from the magazine 12 fills or partially fills the central portions of the pockets 4*a*, and such material maintains its central or substantially central position during transport all the way to the stream growing zone A, namely, a position substantially midway between the lateral sides of the distributor. This, in turn, insures that the material which is removed from the auxiliary magazine 12 does not form the lowermost stratum of the fully grown stream 71 and is not removed by the equalizing device 79. The advantage of such mode of transporting tobacco which is removed from the auxiliary magazine 12 will be readily appreciated, i.e., renewed comminution of tobacco by the equalizing device 79 would reduce it to dust which would contaminate the distributor, the remaining components of the cigarette maker, and the surrounding area.

The equalized stream or filler 71A which advances beyond the device 79 is transferred onto the cigatette paper web 82 on the garniture 81 and is transported through the wrapping mechanism 83 to form part of a continuous cigarette rod. The manner in which the rod is severed to yield discrete plain cigarettes forms no part of the invention.

An important advantage of the improved distributor is that the parts 23, 32 and 33 insure or at least promote the formation of a highly homogeneous tobacco stream. This is attributable to placing of the barrier 33 between the rear wall 27 of the duct 23 and that portion of the path of movement of needles 30 which is adjacent to the lower end of the duct 23, to oscillation of the barrier, and to profiling of its rib 34. The rib 34 guarantees predictable evacuation of the leader (lower end portion) of the relatively small intermediate supply (column) of tobacco from the duct 23 as well as uniform distribution of tobacco particles along the full axial length of the removing conveyor 32. This, in turn, insures uniform filling of gaps or clearances between neighboring needles 30 of the conveyor 32. The hills 35 of the rib 34 promote the passage of tobacco particles through the vallys 36 and the entry of such particles into the aforementioned gaps.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. In the distributor of a cigarette maker or the like wherein particles of fibrous material are converted into a continuous rod-like filler, the combination of a duct having open first and second ends; means for admitting into said duct particles of fibrous material by way of said first end so that the particles form a column, successive increments of which advance toward, and which column has a leader at, said second end, said duct comprising a wall at one side of said column; a conveyor having spaced-apart particle-removing elements arranged to travel along a predetermined path a portion of which is adjacent to said second end and is spaced apart from said wall whereby said elements remove fibrous material from the leader of the column in said duct; and a homogenizing device disposed between said portion of said path and said wall and including means for substantially uniformly distributing fibrous material between the elements advancing beyond said portion of said path; and means for imparting to said device oscillatory movements in a direction substantially transversely of said path.

2. The combination of claim 1, wherein said conveyor is a rotary conveyor and said duct is elongated, as considered in the axial direction of said conveyor, the width of said duct, as considered transversely of the axis of said conveyor, being a small fraction of the length of said duct.

3. The combination of claim 2, wherein said first end is located at a level above said second end and said wall is disposed downstream of said second end, as considered in the direction of rotation of said conveyor.

4. The combination of claim 3, wherein said removing elements are elongated protuberances extending beyond the periphery of said conveyor.

5. The combination of claim 3, wherein said direction is substantially normal to the axis of said conveyor.

6. The combination of claim 1, wherein said device comprises a profiled portion which extends into said second end.

7. The combination of claim 6, wherein said profiled portion is closely adjacent to said portion of said path and said profiled portion has alternating hills and valleys.

8. The combination of claim 7, wherein said portion of said device is an elongated rib and includes a particle-contacting surface bounding said hills and valleys, said surface having a plurality of arcuate portions gradually merging into each other.

9. The combination of claim 8, wherein said conveyor is a rotary conveyor and said rib is substantially parallel to the axis of said conveyor, said direction being substantially normal to said axis and said hills being arranged to promote the passage of particles first between said valleys and thereupon into spaces between the neighboring removing elements in said portion of said path.

10. The combination of claim 1, wherein said first end is the upper end of said duct and said duct has a predetermined length, a height which is a first fraction of said length and a width which is a smaller second fraction of said length, said conveyor being a horizontal rotary conveyor disposed below said second end and said wall, and said wall having a lower end adjacent to but spaced from the apex of said conveyor.

* * * * *